US007044682B2

(12) United States Patent
Glenn et al.

(10) Patent No.: US 7,044,682 B2
(45) Date of Patent: May 16, 2006

(54) MECHANICAL PITCH CONTROL

(75) Inventors: J. Brandal Glenn, Boise, ID (US); Timothy S. Jaskowiak, Boise, ID (US)

(73) Assignee: Multiquip, Inc., Carson, CA (US)

( * ) Notice: Subject to any disclaimer, the term of this patent is extended or adjusted under 35 U.S.C. 154(b) by 0 days.

(21) Appl. No.: 10/749,112

(22) Filed: Dec. 29, 2003

(65) Prior Publication Data

US 2004/0165952 A1 Aug. 26, 2004

Related U.S. Application Data

(60) Provisional application No. 60/437,480, filed on Dec. 31, 2002.

(51) Int. Cl.
*E01C 19/22* (2006.01)

(52) U.S. Cl. ..... 404/112

(58) Field of Classification Search ..... 404/112
See application file for complete search history.

(56) References Cited

U.S. PATENT DOCUMENTS

| | | | | |
|---|---|---|---|---|
| 2,869,441 | A | 1/1959 | Barnes | |
| 2,888,863 | A | 6/1959 | Eisenbeis | |
| 3,000,378 | A * | 11/1961 | Thieme et al. | 404/112 |
| 3,412,657 | A | 11/1968 | Colizza et al. | |
| 3,791,754 | A | 2/1974 | Zochil | |
| 4,198,178 | A | 4/1980 | Carlstrom et al. | |
| 4,232,980 | A | 11/1980 | Tertinek et al. | |
| 4,320,986 | A | 3/1982 | Morrison | |
| 4,577,993 | A | 3/1986 | Allen et al. | |
| 4,673,311 | A | 6/1987 | Whiteman, Jr. | |
| 4,784,519 | A * | 11/1988 | Artzberger | 404/112 |
| 4,859,114 | A * | 8/1989 | Artzberger | 404/112 |
| 5,096,330 | A * | 3/1992 | Artzberger | 404/97 |
| 5,108,220 | A * | 4/1992 | Allen et al. | 404/112 |
| 5,405,216 | A * | 4/1995 | Allen et al. | 404/112 |
| 5,632,570 | A | 5/1997 | Balling | |
| 5,816,739 | A * | 10/1998 | Allen | 404/112 |
| 5,993,109 | A | 11/1999 | Motl et al. | |
| 6,048,130 | A * | 4/2000 | Allen et al. | 404/112 |
| 6,368,016 | B1 * | 4/2002 | Smith et al. | 404/112 |
| 2004/0165952 | A1 * | 8/2004 | Glenn et al. | 404/112 |

* cited by examiner

*Primary Examiner*—Raymond Addie
(74) *Attorney, Agent, or Firm*—Stephen M. Nipper; Dykas, Shave & Nipper

(57) ABSTRACT

A concrete finishing machine having a rotatable trowel blade assembly and a mechanism for controllably adjusting the pitch of the trowel blades relative to a wet concrete surface on which the blades rest. The machine's engine's drive shaft rotation itself is utilized to create changes in pitch.

17 Claims, 5 Drawing Sheets

MECHANICAL PITCH CONTROL

This application claims priority from U.S. application Ser. No. 60/437,480, filed Dec. 31, 2002, having the same inventors, the disclosure of which is incorporated herein by reference.

BACKGROUND OF THE INVENTION

1. Field of the Invention

This invention relates generally to concrete finishing machines, and, more particularly, to apparatus for controllably adjusting the pitch of the trowel blades of such machines.

2. Background Information

Concrete finishing machines have been used for many years to level and finish large concrete pads. Such machines typically include a rotatable trowel blade assembly having a plurality (e.g., three or four) of generally planar trowel blades mounted on trowel arms projecting radially outwardly from a common hub, all of which are rotated by a gasoline-powered engine. The trowel blades rest directly on the concrete surface to be finished and support the machine's entire weight.

Concrete finishing machines typically further include means for controllably pivoting the trowel blades about their respective radial axes, to change their pitch relative to the concrete surface to be finished. Changing the blades' pitch correspondingly changes the proportion of blade surface contacting the concrete surface, such that the machine's weight is supported by a larger or smaller area of the surface.

In use, the machine makes several passes over the concrete surface as the concrete hardens, with the blade pitch being specially selected for each pass. In the initial pass, when the concrete is still very wet and plastic, the blade pitch is usually adjusted to be substantially parallel with the concrete surface, thereby lying flat upon it and spreading the machine's weight over a maximum surface area. In subsequent passes, as the concrete hardens and becomes less plastic, the blade pitch is progressively increased, with the pitch used in the final pass sometimes being as much as about 30 degrees.

Improvements in recent concrete formulations have made some concrete slabs include pockets or areas of varying plasticity. In such situations, it is necessary to rapidly adjust the trowel blade pitch in order to produce the desired finish. It is also necessary to adjust the trowel blade pitch when the machine is being moved to an adjacent area where the concrete is at a different stage of hardness. In this situation, which frequently occurs when very large concrete pads are being formed, the blade pitch must be adjusted very rapidly.

In the past, the pitch of the trowel blades was typically adjusted using a thrust collar that pushed downwardly on fingers projecting upwardly from the rear sides of the respective trowel arms. Typically, such a downward force on the thrust collar is provided by a yoke or fork that is pivotally secured to the machine's frame and connected to an actuator means adjacent the device's handlebars. By operating the actuator means, the pitch yoke is manipulated thereby applying (or removing) a force on the thrust collar. Examples of such a yoke and thrust collar pitch control can be seen in U.S. Pat. Nos. 3,412,657 (Colizza et al.), U.S. Pat. No. 3,791,754 (Zochil), U.S. Pat. No. 4,232,980 (Tertinek et al.), U.S. Pat. No. 4,577,993 (Allen et al.), U.S. Pat. No. 4,673,311 (Whiteman, Jr.), and U.S. Pat. No. 5,405,216 (Allen et al.).

A disadvantage to this use of yoke (or fork) is the fact that the thrust collar is depressed (or lifted) at two points, namely by its contact with the ends of the two arms of the yoke. Having pressure applied at two points can lead to slight tilting of the thrust collar and thereby resulting in wear between the thrust collar and the drive shaft and/or the thrust collar wear bushing inserted between the drive shaft and the thrust collar. What is needed is a method of moving a thrust collar that eliminates this wear caused be the application of pressure by a yoke.

A second disadvantage with a yoke and thrust collar system is the necessity to use cables, chains and other means of moving the yoke. In order to conceal and protect these means, they typically extend from the handlebars to pitch controller via the inside of the handle. Because of this, such a handle is limited in minimum diameter and is unable to be foldable. What is needed is the ability to fold the handle.

A third disadvantage to the prior art yoke and thrust collar system is the fact that the user must physically supply the force necessary to move the thrust collar into engagement with the fingers of the arms of the blades. Various mechanical means are shown in the prior art which help reduce the amount of force required, but the fact remains that the user is still required to physically depress or lift the thrust collar. What is needed is a pitch controller that does not require the user to physically manipulate the thrust collar.

A fourth disadvantage to many renditions of the old yoke system is the convenience of the user. The trailing edge of each trowel blade, which contacts the concrete surface on which the machine rests, is spaced from the blade's pivot axis. Any change in blade pitch therefore transfers the machine's weight by raising or lowering the machine on the surface. Since the machine is generally quite heavy, usually weighing several hundred pounds, the screw handle used for blade pitch adjustment must have threads with a very small pitch to permit the operator to rotate it conveniently. Consequently, the blade pitch adjustment can be made only very slowly. This has been proven to be unsatisfactory in many situations. Some concrete finishing machines have overcome the slow pitch adjustment afforded by the screw handle described above by replacing the screw handle with a long lever attached to the machine's framework. Although this configuration permits a rapid adjustment of the blade pitch, it is not generally convenient to use. This is because the lever requires large movements for lever advantage and because the lever is not conveniently located on the machine handle itself and thus requires the operator to control the machine using merely one hand and unsteady footing. What is needed is a means of changing pitch which requires less digital manipulation than the prior art methods.

It should be appreciated from the foregoing that there is a significant need for a concrete finishing machine having a trowel blade adjustment apparatus that can be used by the operator to mechanically adjust the trowel blade pitch, yet is simple in construction and convenient to use. The present invention fulfills this need.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is an improved pitch controller. Such a pitch controller particularly configured for use with a concrete finishing trowel. The preferred embodiment utilizes the existing mechanical rotation of the drive shaft and/or attached rotors to serve as the source of the force required to raise and lower the weight of the trowel while the pitch of the blades is adjusted. Thus, the present invention includes any means of using the rotation of the drive shaft and/or attached rotors to adjust the pitch of the blades. For instance, using the drive shaft's rotation to maneuver a thrust collar away from the trowel transmission and into engagement with the blade pitch mechanism of the trowel, thereby increasing or decreasing the pitch of the attached blades.

In one embodiment, the present invention comprises an improved concrete finishing trowel or machine. This trowel having a drive means (i.e., engine, motor, turbine, etc.) having extending therefrom a drive shaft. This drive shaft connecting with and configured to rotate a rotatable blade assembly. This rotatable blade assembly adapted to finish a concrete surface. This rotatable blade assembly having a generally vertical axis of rotation and a plurality of radially spaced apart concrete finishing blades extending outwardly from said vertical axis for frictionally contacting the concrete surface. These blades each defining a longitudinal axis generally perpendicular to the vertical axis.

The trowel further having a pitch controller for varying the pitch of the blades by rotating them about their longitudinal axis. This pitch controller utilizing the rotation of the drive shaft to rotate the blades. This pitch controller comprising a thrust collar, a nut, and a bearing. The thrust collar comprising a plate configured to bear downwardly on the rotatable blade assembly thereby varying the pitch of the blades by rotating them about their longitudinal axis. The said thrust collar further comprising a hollow shaft able to receive the drive shaft therethrough, this hollow shaft having an exterior surface which is threaded.

The pitch controller's nut being configured for threading onto the exterior surface of the thrust collar. This nut having an upper surface for supporting a bearing. This bearing configured to support the lower surface of the drive means or other component of the body of the trowel.

Finally, the pitch controller comprises a clutch for selectively engaging and disengaging the pitch controller. In use, the nut can be threaded in a first direction on the thrust collar and towards the thrust collar plate. Likewise, the nut can be threaded in an opposite, second direction on the thrust collar and away from the thrust collar plate. Travel in the first direction resulting in a reduction in the degree of downward bearing upon the rotatable blade assembly by the thrust collar plate thereby resulting in a decrease in pitch. Travel in the second direction resulting in an increase in the degree of downward bearing upon the rotatable blade assembly by the thrust collar plate thereby resulting in an increase in pitch.

In this preferred embodiment, the drive means drives the drive shaft thereby rotationally driving the thrust collar and the rotatable blade assembly. The clutch is configured to stop the nut while the drive means is driving, thereby resulting in travel in the second direction and moving the thrust collar away from the nut. Likewise, the clutch is configured to transmit the rotation of the thrust collar to achieve travel in the second direction thereby drawing the thrust collar nearer the nut. This is particularly seen where the diameter of the thrust collar is greater than the nut, whereby rotation of the thrust collar results in expedited rotation of the nut.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
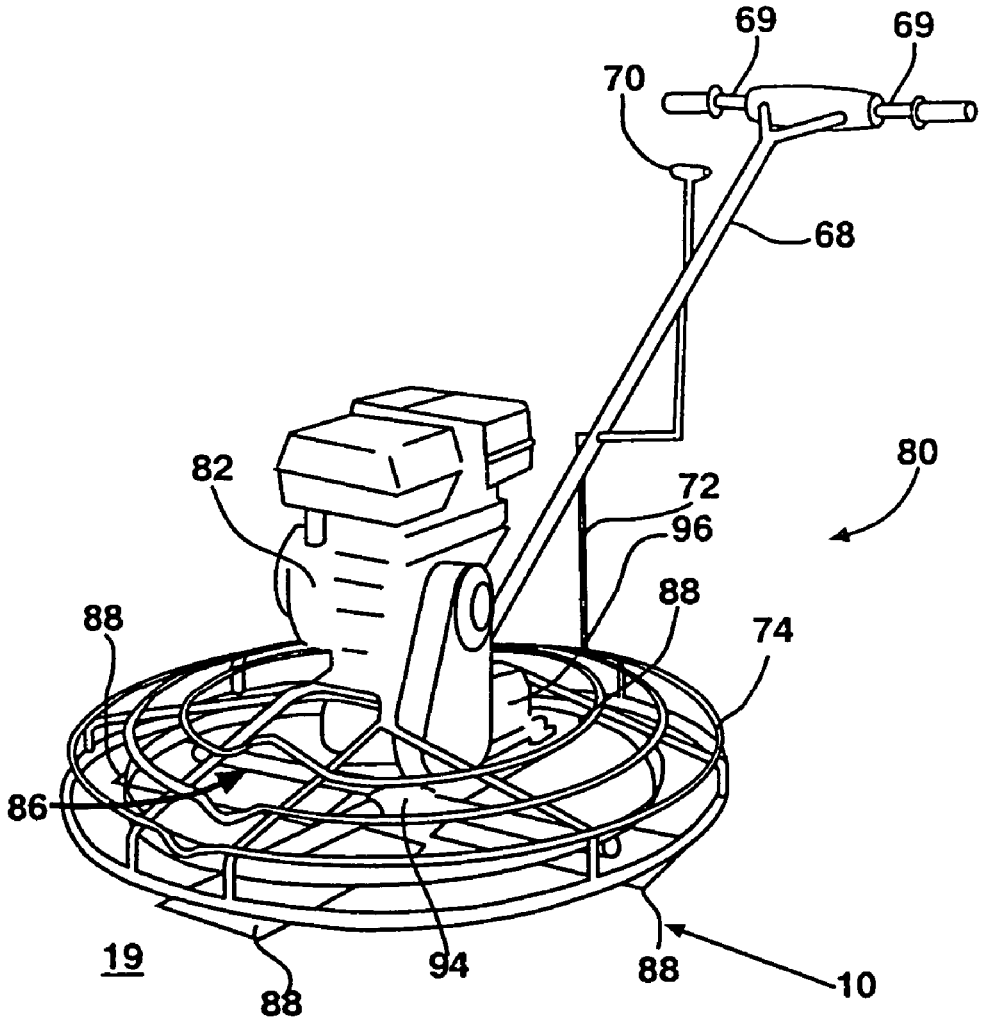
FIG. 1 is a perspective view of one embodiment of a power trowel utilizing the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 2:
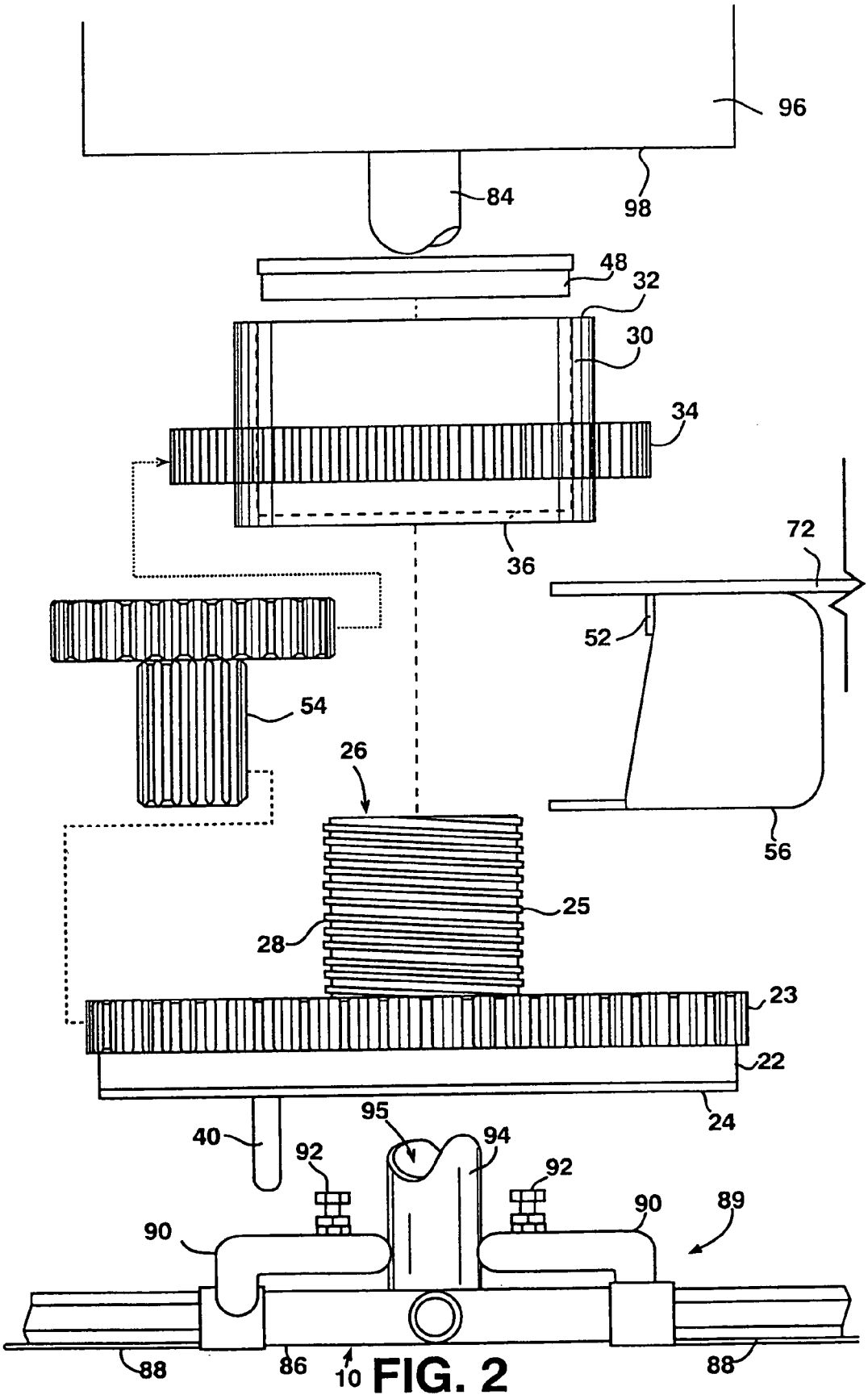
FIG. 2 is an exploded, side view of a first embodiment of the present invention.

Referring initially to FIGS. 1 and 2, for purposes of illustration, the present invention is embodied in a concrete finishing machine 80 of the kind that includes a rotatable trowel blade assembly or spider 86 rotatably driven by a suitable drive means or engine 82. This drive means having a drive shaft 84 which is typically keyed or locked into the hub 95 of the trowel blade assembly 86. The trowel blade assembly 86 includes a plurality (e.g., three or four) of uniformly-spaced trowel blade arms 90 projecting radially outwardly from a common hub 94, each arm 90 carrying a separate substantially planar concrete finishing or trowel blade 88.

The blades 88 are configured to rest directly on a wet, semi-plastic concrete surface 19 to be finished and these blades 88 support the machine's 80 entire weight. The blades 88 are all pivotable about their respective radial axes to typically change their pitch relative to the concrete surface 19 over a range typically extending from substantially 0 degrees to about 30 degrees. This pivoting changes the area of the blade surface contacting the concrete and thus changes the pressure applied to the concrete. The pivoting also correspondingly raises or lowers the machine on the surface.

Figure 3:
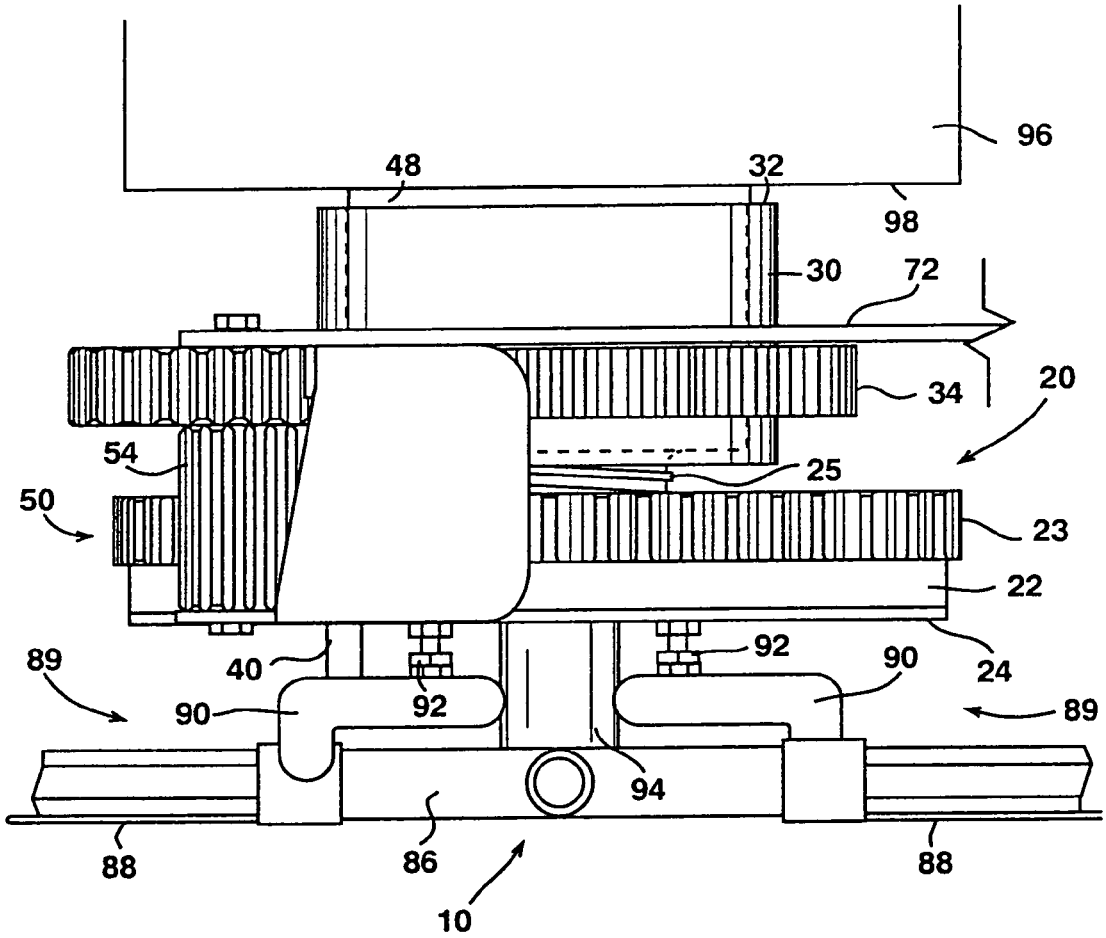
FIG. 3 is a side view of a second embodiment of the present invention shown with no pitch applied to the blades.
Figure 4:
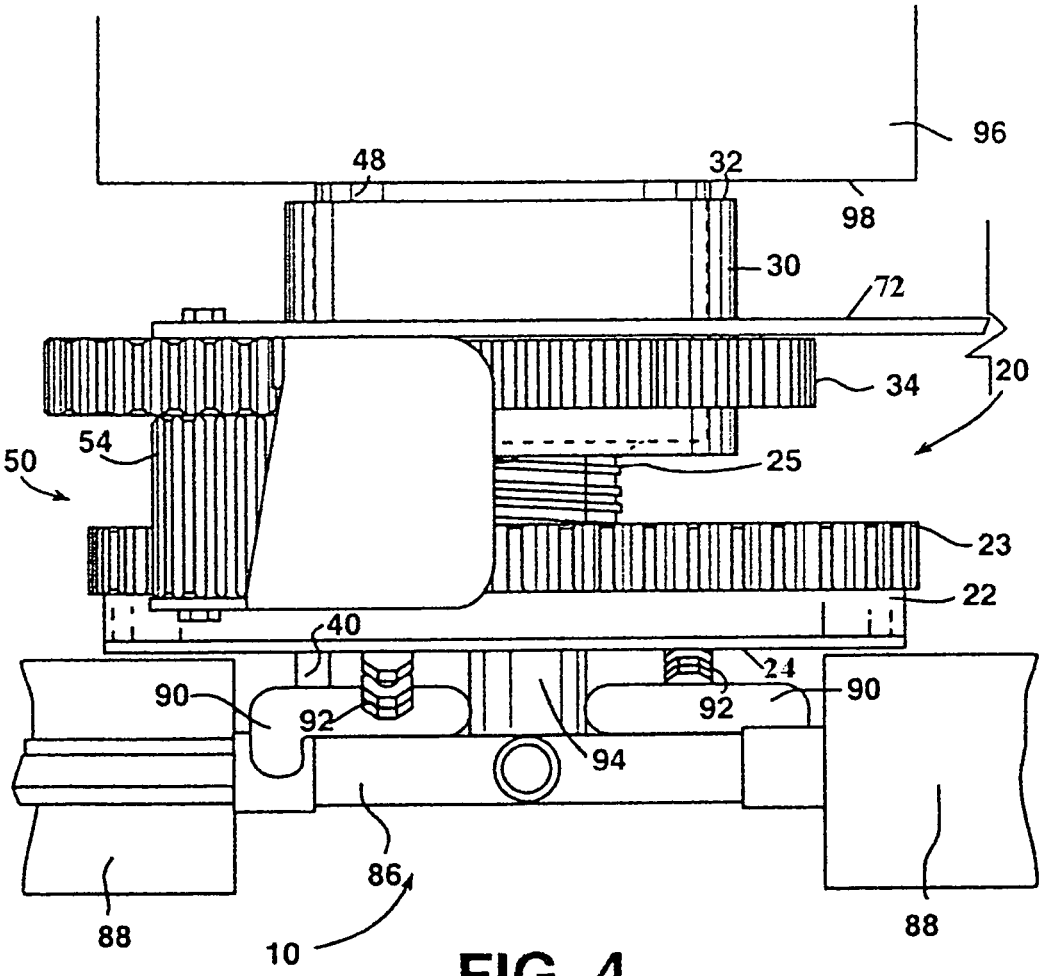
FIG. 4 is a side view of the embodiment of FIG. 3, showing pitch applied to the blades
Figure 5:
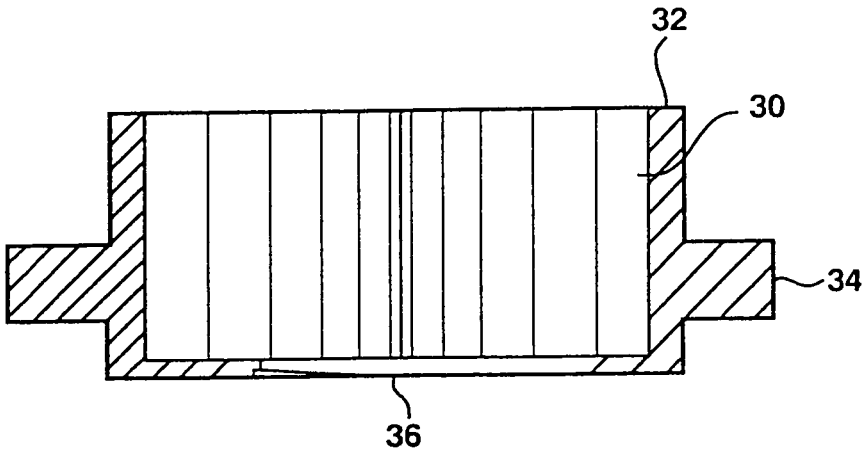
FIG. 5 is a cross-sectional view of one embodiment of a nut of the present invention.

Referring now to FIGS. 2–4, this rotatable trowel blade assembly or spider 86 has a central blade hub 94 to which said pivotable blades 88 attach. This hub 94 having a shaft connection 95 extending therethrough allowing the hub 94 to be fixed upon the drive shaft 84 descending from the drive means of the concrete finishing machine or trowel, the drive shaft 84 able to be inserted into the shaft connection 95, with a pin, screw, key or other connection connecting the drive shaft to the hub at said drive shaft connection 95.

Figure 6:
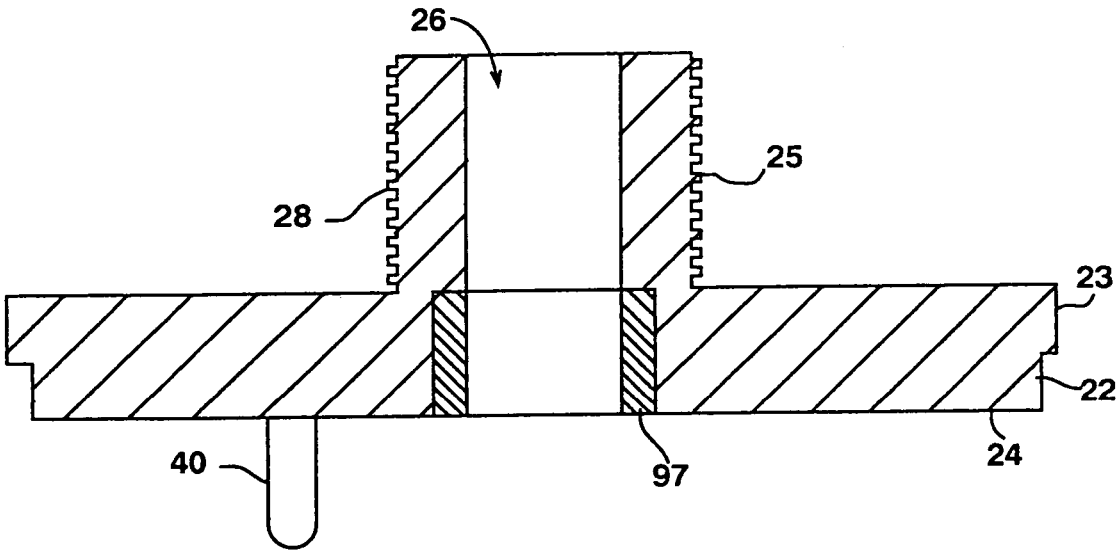
FIG. 6 is a cross-sectional view of one embodiment of a thrust collar of the present invention.

The thrust collar 22, preferably lined with an oil-impregnated thrust collar bushing 97 (shown in FIG. 6), is fitted over the hub (before the shaft is connected to the hub). This thrust collar 22 able to be moved upwards or downwards upon said hub. The replaceablility of said bushing 97 allowing for easy reconditioning of the trowel. In such a manner, the bushing engages the hub in a manner that allows the thrust collar to more efficiently slide up and down upon the hub. Of course, the utilization of such a bushing is optional.

Referring now to FIGS. 2–4, and 6, the thrust collar 22 of the present invention 10 has a geared rim 23 and an elongated, threaded neck 25. This neck 25 defining a hollow shaft 26 therethrough (FIG. 6) for receiving the bushing 97 and/or the upper portion of the hub 94. This treaded neck 25 for receiving thereon a nut 30 having a portion containing interior threads 36. The thrust collar 22 defining a thrust collar body or plate 24 for cooperating with the fingers 92 and/or arms 90 of the spider (blade assembly) 86 to increase or decrease the pitch of the attached concrete finishing blades 88.

Optionally, as shown in FIGS. 2–4, the thrust collar 22 may additionally comprise a pin 40 extending from said plate 24 generally perpendicular to said plate. This pin 40 for contacting said blade assembly (spider) 86, thereby keeping the thrust collar 22 from rotating separately from the blade assembly 86, thereby reducing wear and tear upon the thrust collar and fingers/arms of the blade assembly. Thus, one embodiment of the present invention may comprise a standard thrust plate utilized with the prior art yoke style of engagement which includes a pin 40 extending from said plate, generally perpendicular to said plate.

The nut 30 is provided having a geared rim 34 and a threaded inner surface 36 able to receive therein the threading of the thrust collar's threaded neck 28. This nut 30 is able to travel along the threaded neck 28 of the thrust collar 22. The upper surface 32 of the nut 30 is configured to support a bearing 48 which in turn supports the bottom 98 of the transmission case 96, the drive means lower surface or another portion of the concrete finishing trowel.

In use, the drive shaft 84 turns the spider 86 and the thrust collar 22. The nut 30, being threaded onto the thrust collar 22, rotates with the thrust collar 22 by default. As shown in FIG. 4, to increase the pitch of the blades 88, a user would manipulate the control handle to engage the clutch 50 into a first position via the interconnector 72 to stop the nut 30. In the preferred embodiment, a pawl 52 is utilized to stop the rotation of the nut 30. Stopping the rotation of the nut 30 causes the nut 30 to unscrew (screw up on the thrust collar neck 25). Because the nut 30 is already topped out against the bearing 48 which supports the transmission case bottom 98 or other portion of the trowel, the thrust collar 22 actually unscrews out of the nut 30 downwards carrying the rotation of drive shaft 84. The preferred clutch 50 is shown in the figures, however other clutches and manners of engaging and/or disengaging the invented pitch controller are also envisioned. The preferred clutch is a manner of stopping the rotation of the nut while allowing the thrust collar to continue to rotate.

As the thrust collar 22 unscrews downwards from the nut, the underside 24 of the thrust collar plate bears downwardly on the blade pitch mechanism 89 of the trowel blades, namely upon the fingers 92. This downward force upon the fingers 92 causes the arms 90 to rotate about their respective radial axes and thus increases the pitch of the blades 88. When the desired degree of pitch is obtained, the user would manipulate the control handle to cause the gear 54 to release the nut 30, thereby moving the clutch 50 into its neutral position.

As shown in FIG. 3, to reverse this process and decrease the pitch, the clutch 50 would be moved by the user via the control handle and attached interconnector 72 to the clutch's second position. In this second position, a gear 54 (or connected pair of gears) having a couple of different diameters would be engaged against the geared rims 23, 34 of the thrust collar 22 and the nut 30. This gear 54 used to make the nut 30 rotate at a speed greater than the rotation of the thrust collar 22, thereby resulting in the thrust collar 22 screwing back into the nut 30.

At any desired point, the user could disengage this gear 54 by moving the clutch 50 into "neutral" thereby stopping the screwing back in. This process allowing for an infinite adjustment in the reduction of the pitch. Allowing for the total screwing back in of the thrust collar would preferably result in generally zero degree of pitch.

Referring back to FIG. 1, for safety, a guard ring 21 encircles the peripheral tips of the trowel blades. An operator (not shown) can guide and control the machine using a machine handle 68, preferably having one or more handlebars 69. In the preferred embodiment, the pitch of the trowel blades 88 relative to the concrete surface 19 on which they rest can be manually adjusted using a control lever 70 pivotally secured to the machine handle 68. This pitch adjustment is made according to the concrete's hardness or plasticity, beginning with the blades lying substantially flat on the surface when the concrete is very wet or plastic and ending with the blades at a substantial angle (e.g., 30 degrees) when the concrete has substantially hardened. The control lever 70 is connected to the rotatable trowel blade assembly 86 through use of a interconnector 72. However, any and all other manners of engaging and disengaging the clutch is also envisioned.

Referring now to FIG. 4, to transform movement of the interconnector 72 into pivoting of the individual trowel blades 88, the trowel blade assembly 86 includes an improved pitch controller 10 having a thrust collar 22 overlaying the blade hub 94. In addition, each trowel blade includes an outwardly and upwardly projecting arm 90, this arm configured to act as a crank for pivoting the blade about its radial axis. The head of an adjustment screw or "finger" 92 projects upwardly from the end of the arm for engagement with the underside of the thrust collar.

In the embodiment shown, the interconnector 72 is connected to a clutch 50 for selectively engaging and disengaging the pitch controller 10. In the preferred embodiment, the clutch 50 has three modes, namely "increase pitch," "maintain pitch" and "decrease pitch."

When the clutch 50 is, via said control handle 70 and said interconnected interconnector 72, in the "increase pitch" mode, the pitch controller is engaged to increase pitch. In the preferred embodiment, when in this mode, the clutch 50 engages a pawl 52 which stops the rotation of the nut 30. Stopping the rotation of the nut, as discussed above, causes the thrust collar 22 to unscrew out of the nut 30 thereby resulting in the thrust collar 22 depression of the fingers 92 of the blade pitch mechanism 89 resulting in the rotation of the trowel blades about their radial axis, increasing pitch. This action is particularly shown in FIG. 4.

When the clutch is, via said control handle 70 and said interconnected interconnector 72, in the neutral ("maintain pitch") mode, the pitch controller is left in its current degree of pitch. In the preferred embodiment, in such a mode, the nut 30 remains in a fixed location upon the treads of the thrust collar, rotating at the exact same rate as the thrust collar, maintaining the position of the trust collar and thus the current degree of pitch.

When the clutch 50 is, via said control handle 70 and said interconnected interconnector 72, in the "decrease pitch" mode, the pitch controller 10 is engaged to decrease pitch. In the preferred embodiment, when in this mode, the clutch 50 engages a gear 54 which engages both the geared rim 23 of the thrust collar and the geared rim 34 of the nut. This dual gear 54 geared to cause the nut 30 to rotate at a rate greater than the rotation of the thrust collar 22, thereby screwing the thrust collar 22 back into the nut 30. This results in the thrust collar 22 exerting less pressure downwards on the fingers 92 of the blade pitch mechanism 89, thereby resulting in a reduction in the rotation of the trowel blades about their radial axis, decreasing pitch.

In another embodiment, the present invention could utilize rubber rollers and coated surfaces to achieve the same effect as the utilization of clutch gear or cog and the geared edge of the nut and the geared edge of the thrust collar.

Another embodiment of the present invention comprises a thrust collar having a neck having a threaded outer surface.

Another embodiment of the present invention comprises a thrust collar having a generally perpendicular pin extending therefrom for contacting the spider (rotatable blade assembly).

Because the prior art devices required engagement and disengagement mechanisms which at least partially transit through a hollow handle, the present invention comprises, in another embodiment, a power trowel having a folding handle, with or without the invented pitch controller.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

We claim:

1. A concrete finishing trowel comprising:

a drive means having extending therefrom a drive shaft, said drive shaft connecting with and configured to rotate a rotatable blade assembly;

said rotatable blade assembly adapted to finish a concrete surface, said rotatable blade assembly having a generally vertical axis of rotation and a plurality of radially spaced apart concrete finishing blades extending outwardly from said vertical axis for frictionally contacting said concrete surface, said blades each defining a longitudinal axis generally perpendicular to said vertical axis;

a pitch controller for varying the pitch of said blades by rotating said blades about their longitudinal axis, said pitch controller utilizing the rotation of said drive shaft to supply the force necessary to rotate said blades about their longitudinal axis, wherein said pitch controller comprises a thrust collar, said thrust collar having a plate configured to bear downwardly on said rotatable blade assembly thereby varying the pitch of said blades by rotating them about their longitudinal axis, wherein said thrust collar further comprises a hollow shaft able to receive said drive shaft therethrough, said hollow shaft having a threaded exterior surface configured for receiving a nut thereupon; and, a clutch for selectively engaging and disengaging said pitch controller.

2. The trowel of claim 1, wherein said pitch controller further comprises said nut, said nut threaded onto said thrust collar threaded exterior surface, said nut having an upper surface.

3. The trowel of claim 2, wherein said pitch controller further comprises a bearing configured to support a drive means lower surface on said nut upper surface.

4. The trowel of claim 3, wherein said nut can be threaded in a first direction on said thrust collar and towards said thrust collar plate, and wherein said nut can be threaded in an opposite, second direction on said thrust collar and away from said thrust collar plate.

5. The trowel of claim 4, wherein travel in said first direction results in a selective reduction in the degree of downward bearing force upon said rotatable blade assembly by said thrust collar plate thereby resulting in a decrease in pitch.

6. The trowel of claim 5, wherein travel in said second direction results in a selective increase in the degree of downward bearing force upon said rotatable blade assembly by said thrust collar plate thereby resulting in an increase in pitch.

7. The trowel of claim 6, wherein said drive means drives said drive shaft thereby rotationally driving said thrust collar and said rotatable blade assembly.

8. The trowel of claim 7, wherein said clutch is configured to stop said nut while said drive means is driving thereby resulting in travel in said second direction and moving said thrust collar away from said nut; thereby increasing the pitch of the trowel blades.

9. The trowel of claim 8, wherein said clutch is configured to transmit the rotation of said thrust collar to achieve travel in said second direction thereby drawing the thrust collar nearer said nut; thereby decreasing the pitch of the trowel blades.

10. A concrete finishing trowel comprising:

a drive means having extending therefrom a drive shaft, said drive shaft connecting with and configured to rotate a rotatable blade assembly;

a rotatable blade assembly adapted to finish a concrete surface, said rotatable blade assembly having a generally vertical axis of rotation and a plurality of radially spaced apart concrete finishing blades extending outwardly from said vertical axis for frictionally contacting said concrete surface, said blades each defining a longitudinal axis generally perpendicular to said vertical axis;

a pitch controller for varying the pitch of said blades by rotating them about their longitudinal axis, said pitch controller utilizing the rotation of said drive shaft to rotate said blades about their longitudinal axis, said pitch controller comprising a thrust collar, a nut, and a bearing;

said thrust collar comprising a plate configured to bear downwardly on said rotatable blade assembly thereby varying the pitch of said blades by rotating them about their longitudinal axis, said thrust collar further comprising a hollow shaft able to receive said drive shaft therethrough, said hollow shaft having a threaded exterior surface;

said nut configured for threading onto said thrust collar exterior surface, said nut having an upper surface; and said bearing configured to support a drive means lower surface on said nut upper surface; and a clutch for selectively engaging and disengaging said pitch controller.

11. The trowel of claim 10, wherein said nut can be threaded in a first direction on said thrust collar and towards said thrust collar plate, and wherein said nut can be threaded in an opposite, second direction on said thrust collar and away from said thrust collar plate.

12. The trowel of claim 11, wherein travel in said first direction results in a selective reduction in the degree of downward bearing force upon said rotatable blade assembly by said thrust collar plate thereby resulting in a decrease in pitch.

13. The trowel of claim 12, wherein travel in said second direction results in selective increase in the degree of downward bearing force upon said rotatable blade assembly by said thrust collar plate thereby resulting in an increase in pitch.

14. The trowel of claim 13, wherein said drive means drives said drive shaft thereby rotationally driving said thrust collar and said rotatable blade assembly.

15. The trowel of claim 14, wherein said clutch is configured to stop said nut while said drive means is driving thereby resulting in travel in said second direction and moving said thrust collar away from said nut; thereby increasing the pitch of the trowel blades.

16. claim 15, wherein said clutch is configured to transmit the rotation of said thrust collar to achieve travel in said second direction thereby drawing the thrust collar nearer said nut; thereby decreasing the pitch of the trowel blades.

17. A concrete finishing trowel comprising:

a drive means having extending therefrom a drive shaft, said drive shaft connecting with and configured to rotate a rotatable blade assembly;

a rotatable blade assembly adapted to finish a concrete surface, said rotatable blade assembly having a generally vertical axis of rotation and a plurality of radially spaced apart concrete finishing blades extending outwardly from said vertical axis for frictionally contacting said concrete surface, said blades each defining a longitudinal axis generally perpendicular to said vertical axis;

a pitch controller for varying the pitch of said blades by rotating them about their longitudinal axis, said pitch controller utilizing the rotation of said drive shaft to rotate said blades about their longitudinal axis, said pitch controller comprising a thrust collar, a nut, and a bearing;

said thrust collar comprising a plate configured to bear downwardly on said rotatable blade assembly thereby varying the pitch of said blades by rotating them about their longitudinal axis, said thrust collar further comprising a hollow shaft able to receive said drive shaft therethrough, said hollow shaft having a threaded exterior surface;

said nut configured for threading onto said thrust collar exterior surface, said nut having an upper surface;

said bearing configured to support a drive means lower surface on said nut upper surface; and a clutch for selectively engaging and disengaging said pitch controller;

wherein said nut can be threaded in a first direction on said thrust collar and towards said thrust collar plate, and wherein said nut can be threaded in an opposite, second direction on said thrust collar and away from said thrust collar plate;

wherein travel in said first direction results in a reduction in the degree of downward bearing upon said rotatable blade assembly by said thrust collar plate thereby resulting in a decrease in pitch;

wherein travel in said second direction results in an increase in the degree of downward bearing upon said rotatable blade assembly by said thrust collar plate thereby resulting in an increase in pitch;

wherein said drive means drives said drive shaft thereby rotationally driving said thrust collar and said rotatable blade assembly;

wherein said clutch is configured to stop said nut while said drive means is driving thereby resulting in travel in said second direction and moving said thrust collar away from said nut; and wherein said clutch is configured to transmit the rotation of said thrust collar to achieve travel in said first direction thereby drawing the thrust collar nearer said nut.

* * * * *